US005964270A

United States Patent [19]

Kirkey et al.

[11] Patent Number: 5,964,270

[45] Date of Patent: Oct. 12, 1999

[54] ROLL-UP DOOR WITH LOW FRICTION EDGES

[75] Inventors: Calvin Kirkey, Utopia; David Quigg, Argus, both of Canada

[73] Assignee: M & I Door Systems Limited, Ontario, Canada

[21] Appl. No.: 08/949,884

[22] Filed: Oct. 14, 1997

[30] Foreign Application Priority Data

Jul. 11, 1997 [CA] Canada ..... 2-210-283

[51] Int. Cl.[6] ..... E06B 9/17

[52] U.S. Cl. ..... 160/273.1; 160/264

[58] Field of Search ..... 160/273.1, 271, 160/272, 265, 264, 310

[56] References Cited

U.S. PATENT DOCUMENTS

| | | | |
|---|---|---|---|
| Re. 18,716 | 1/1933 | Dixson . | |
| 2,501,454 | 3/1950 | Schueren . | |
| 3,116,097 | 12/1963 | Novales . | |
| 3,292,685 | 12/1966 | Clark | 160/264 |
| 3,430,677 | 3/1969 | Pierce | 160/264 |
| 4,126,174 | 11/1978 | Moriarty et al. | 160/266 |
| 4,175,608 | 11/1979 | Alten | 160/273 |
| 4,478,268 | 10/1984 | Palmer | 160/310 |
| 4,601,320 | 7/1986 | Taylor | 160/271 |
| 4,690,195 | 9/1987 | Taylor | 160/310 |
| 4,800,946 | 1/1989 | Rosenoy | 160/264 |
| 5,139,074 | 8/1992 | Warner | 160/271 |
| 5,163,495 | 11/1992 | Lichy | 160/273.1 |
| 5,170,833 | 12/1992 | Taylor et al. | 160/310 |
| 5,307,859 | 5/1994 | Kraeutler | 160/264 |
| 5,353,858 | 10/1994 | Hartmann | 160/264 |
| 5,379,823 | 1/1995 | Kraeutler | 160/271 |
| 5,482,104 | 1/1996 | Lichy | 160/273.1 |
| 5,579,820 | 12/1996 | Lepage et al. | 160/268.1 |

*Primary Examiner*—David M. Purol
*Attorney, Agent, or Firm*—Barry R. Lipsitz

[57] ABSTRACT

A roll-up type industrial door including a flexible vinyl sheet forming a curtain for closing a door way having an upper end, a lower end and two opposite side edges. The sheet has a thin main area and elongate side edge sections that are thicker than the main area. A sloping shoulder is formed where each side edge section meets the main area. A curtain winding mechanism is connected to the upper end of the curtain and is used to raise the curtain. A pair of spaced apart guide channels are also provided and the side edge sections are movable therein. Friction reducing, wear resistant fabric strips are bonded to both of the side edge sections and extend therealong. These strips cover the sloping shoulders and are bonded thereto. The strips reduce the amount of friction between the side edge sections and their respective guide channels. Preferably the strips are made of one ply polyester monofilament.

23 Claims, 3 Drawing Sheets

ROLL-UP DOOR WITH LOW FRICTION EDGES

BACKGROUND OF THE INVENTION

This invention relates to roll-up doors intended for use in industrial and commercial buildings and structures and, in particular, roll-up doors that include a flexible sheet forming a curtain for closing a doorway and a pair of spaced apart guide channels in which side edge sections of the curtain are respectively movable.

Roll-up doors for industrial and commercial use have been known for some time and, depending on the precise construction of the particular door, such doors can have a number of advantages. For example, light weight vinyl doors can be made to operate relatively quickly while, at the same time, such doors can have a relatively clean, pleasing appearance. Such doors can be relatively quiet in their operation as they can be operated quickly and efficiently by means of a suitable electrical motor and push button controls.

U.S. Pat. No. 4,478,268 issued Oct. 23, 1984 to Copper Cliff Door Manufacturing (1980) Limited, describes a so-called damage-minimizing door for closing a vehicular passageway in which the door is constructed of a tough rubber or rubber-like material. The curtain is secured along its top edge to a curtain winding mechanism that includes a winding drum supported in mounting brackets. The bottom edge of the curtain is connected to a base bar constructed of angle members and a flat bar. In this curtain, the side edges of the curtain can be pulled laterally through the slot mouth formed by each guide channel when a predetermined impact force is applied to the curtain.

The preferred rubber curtain as described in U.S. Pat. No. 4,478,268 has a thickened area extending along each side edge of the curtain. Each guide channel of the door has a throat of reduced width for restricting movement of the thickened edge area of the curtain out of the channel. The throat of the guide channel is narrower than the thickened edge area of the curtain. The thickened edge area can be provided with a sloping shoulder on the side thereof where the thickened area meets the thin main area of the curtain. One difficulty with this known curtain structure is that there can be substantial friction between the thick rubber edges of the curtain and the metal guide channels, particularly if the curtain is subject to significant wind or air pressure on one side thereof and this can result in problems with the operation of this door.

U.S. Pat. No. 4,601,320 issued Jul. 22, 1986 to Douglas Taylor describes an improved industrial door wherein friction reducing devices in the form of plastic strips constructed with ultra-high molecular weight plastic are bonded to the thickened side edge sections of a rubber or synthetic rubber curtain. These plastic strips extend along the side edge sections of the curtain and are provided to reduce the amount of friction between the side edge sections and the guide channels. On one side of the curtain these strips are spaced apart in an end-to-end relationship so that they will not interfere with the raising or lowering of the rubber curtain. Although such plastic strips have worked satisfactorily, a problem with such strips is that the plastic material from which they are made is relatively expensive and the process of bonding the strips in the desired fashion to the door edges is fairly labour intensive and adds significantly to the cost of the door.

U.S. Pat. No. 5,170,833 issued Dec. 15, 1992 to M & I Door Systems Limited describes a relatively high speed roll-up door wherein the curtain is made from a relatively thin plastic or fabric sheet. The top end of the thin curtain is mounted to a rotatable curtain roll which is operatively connected to an electric door operator. Two vertical guide channels are arranged on opposite sides of the door opening and act to guide the flexible curtain along the correct path. Each guide channel is constructed of two guide plates which can be made of steel or aluminum. The door itself is provided with a rigid bottom bar which extends the width of the door opening and into the guide channels. A safety edge device of known construction is provided along a bottom of the bottom bar. Each end of the bottom bar can be provided with a strip of friction reducing material made of the aforementioned ultra-high molecular weight plastic. These plastic strips help to reduce friction between an end plate of the bottom bar and a flange of a front guide plate of each guide channel.

The roll-up door of the present invention is provided with relatively inexpensive, wear resistant fabric strips that are attached to the side edge sections of the flexible sheet forming the door. These strips which extend in a direction parallel to the side edges of the door curtain cover the sloping shoulders formed between the thicker side edge sections of the curtain and the relatively thin main area of the curtain. These fabric strips reduce the amount of friction between the side edge sections of the curtain and their respective guide channels.

It is an object of the present invention to provide a roll-up door that can be manufactured more easily and at less cost than the previously known flexible rubber roll-up doors described above. In a preferred embodiment of the present roll-up door, the thicker side edges sections of the curtain can generally be pulled under an impact force from the guide channels, often without significant damage to the curtain, and the friction reducing fabric strips assist in the release of the side edge sections from their respective channels.

SUMMARY OF THE INVENTION

According to one aspect of the invention, a roll-up door comprises a flexible sheet forming a curtain for closing a doorway having an upper end, a lower end and two opposite side edges. The sheet has a relatively thin main area and elongate side edge sections that are thicker than the remainder of the sheet. A sloping shoulder is formed where each side edge section meets the main area. The door includes a curtain winding mechanism having the upper end of the curtain attached thereto for raising the curtain and a pair of spaced apart guide channels in which the side edges sections are respectively movable. The side edge sections are engageable respectively with the guide channels. Friction reducing, wear resistant fabric strips are attached to both of the side edge sections and extend therealong in a direction parallel to the side edges. These strips include fabric strips covering and attached to the sloping shoulders. The strips reduce the amount of friction between the side edge sections and their respective guide channels.

The preferred fabric strips are made of one-ply polyester monofilament and the strips are coated with polyvinyl chloride (PVC) on one side, this side being bonded to the respective side edge section of the curtain.

According to another aspect of the invention, a roll-up door comprises a vertically movable flexible curtain for closing a doorway, this curtain having an upper end, a lower end, and side edges, and having a relatively thin main area and a thicker strip along a substantial length of each side edge with each strip forming a windlock. A sloping shoulder is formed where each strip meets the main area. There are also provided a curtain winding mechanism having the upper end of the curtain attached thereto for raising and lowering the curtain and a curtain guide system including a pair of spaced apart guide channels in which the side edges, including the thicker strips, are respectively movable. Each thicker strip is engageable with its respective guide channel. Friction reducing, wear resistant polyester fabric strips are bonded to both of the thicker strips and extend therealong in a direction parallel to the side edges. These fabric strips include fabric strips covering and bonded to the sloping shoulders. The strips reduce the amount of friction between the thicker strips and their respective guide channels when the curtain is raised or lowered.

Preferably each thicker strip is formed by an elongate vinyl member of substantial uniform transverse cross-section bonded to a respective side edge section of a vinyl sheet forming most of the curtain.

Further features and advantages will become apparent from the following detailed description taken in conjunction with the accompanying drawings.

DETAILED DESCRIPTION OF PREFERRED EMBODIMENT

Figure 5:
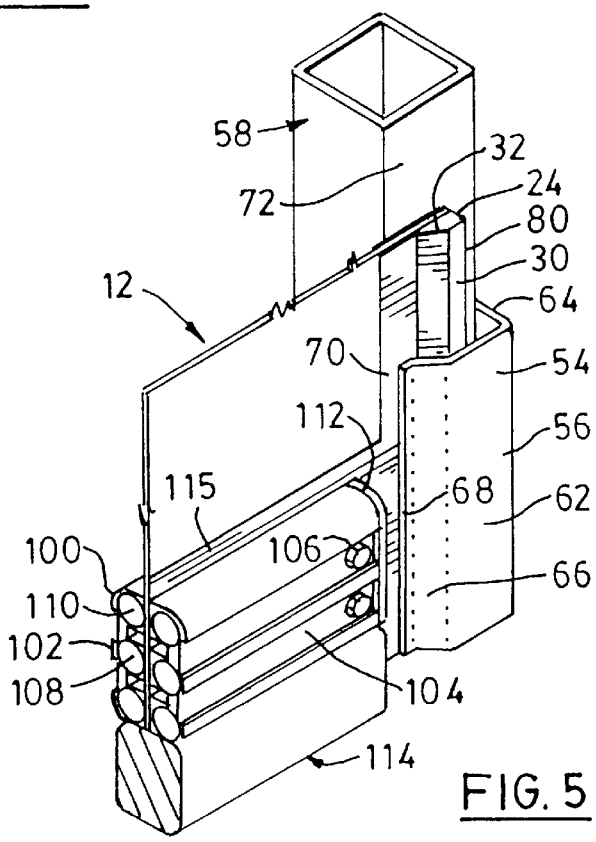
FIG. 5 is a detail perspective view showing a bottom right hand corner of the door assembly of FIG. 2.

A roll-up door or door assembly 10 constructed in accordance with the invention includes a flexible sheet 12 forming a curtain for closing a doorway 14 which may be provided in a wall 16 of a building or other structure. Often a roll-up door 10 of this type is used in a commercial or industrial building and commonly it is used to open and close an interior doorway. The curtain has an upper end 18, a lower end 20 and two opposite side edges 22 and 24. The sheet 12 has a relatively thin main area 26 which covers most of the sheet and two elongate side edge sections 28 and 30 which, as can be seen from FIG. 5, are thicker than the remainder of the sheet. A sloping shoulder 32 is formed where each side edge section meets the main area 26 or, in other words, the shoulder 32 is formed on the exposed side of the side edge section which is adjacent the thin main area.

In a manner known per se, the upper end 18 of the curtain is mounted to a rotatable curtain roll or drive barrel 34 which is part of a curtain winding mechanism used to raise and lower the curtain. The curtain winding mechanism also includes an electric door operator 36. The operator includes an electric motor 38 which is connected by means of a drive chain 40 to a door sprocket 42. Electric lines (not shown) connect the electric door operator to a wall mounted push button control panel 44. As the curtain winding mechanism is of known construction, a detailed description thereof herein is deemed unnecessary. In order to improve the appearance of the assembly, the drive barrel 34 can be partially or wholly enclosed by a hood 46.

The flexible door curtain 12 is rolled around the horizontal drive barrel 34 that extends across the top of the door opening 14. The roll 34 has a shaft section 48 projecting outwardly from each end, each section being rotatably mounted in a suitable bearing mounted on a support bracket 50.

The roll-up door 10 includes a pair of spaced apart guide channels 52, 54 in which the side edge sections 28, 30 are respectively movable. These side edge sections are engageable with the guide channels 52, 54 and are normally held therein as explained in more detail hereinafter. Each of the guide channels 52, 54 is constructed in essentially the same manner and reference will be made herein to the guide channel 54 which can be seen in some detail in FIGS. 5 and 6. In the preferred embodiment of the door, each guide channel includes an elongate, metal front plate 56 and an elongate metal rear guide member 58 which, in the illustrated preferred embodiment, is in the form of a tubular member having a generally square horizontal cross-section. The front plate 56 is detachably connected to the rear guide member 58 if desired by means of washers and bolts 59. Preferably the front plate is slotted at 61 at each bolt location to permit the guide throat to be adjusted and to permit reinsertion of the curtain edge after an impact on the curtain. The two guide members 56, 58 can be made of steel or preferably aluminum. In a known manner, the rear guard member 58 is connected to the adjoining wall 16, such as by mounting bolts (not shown). Both guide members extend at least the height of the doorway 14 (and preferably higher than the existing lintel) and their bottom ends are located adjacent the floor or ground surface 60. The illustrated preferred front plate 56 includes longitudinally extending front leg 62 and a side leg 64 which extends perpendicular to the front leg and is connected to the rear guide member 58. The front leg 62 preferably includes a sloping inner edge portion 66 which extends to an inner edge 68, which is vertical when the door is installed in a doorway. In a manner known per se, a narrow throat 70 is formed between the inner edge 68 and front side 72 of rear guide member 58. The curtain or sheet 12 extends through the throat 70 formed by each guide channel. As can be seen clearly in FIG. 6, each side edge section 28, 30 has a total thickness (measured in a direction perpendicular to the front side 72) which is greater than the width of the throat 70 so that each thicker side edge section 28, 30 is normally trapped in its respective guide channel.

Figure 6:
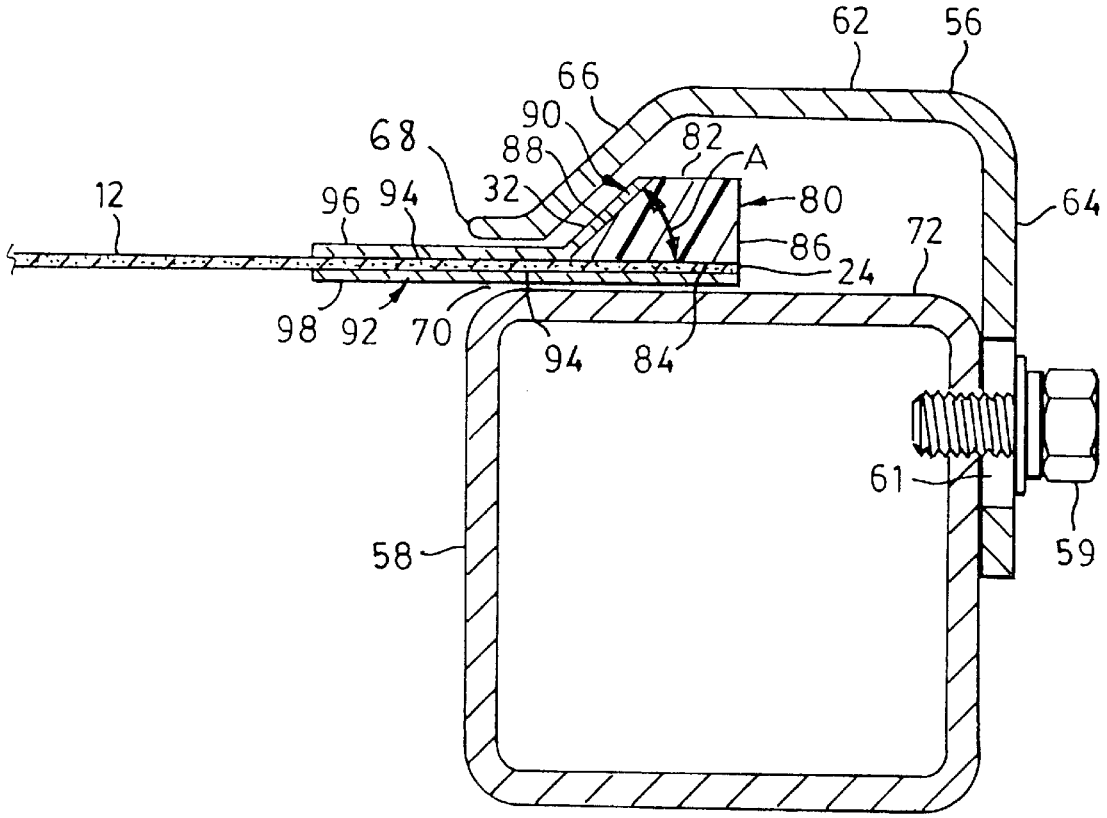
FIG. 6 is a horizontal cross-sectional view providing details of one guide channel and an edge section of the door curtain.

Preferably, the thicker side edge section is made with the use of an elongate polyvinylchloride (PVC) member which is bonded to the vinyl sheet of the curtain 12. The preferred vinyl or PVC member 80 has a substantially uniform transverse cross-section having the shape of a trapezoid. As illustrated in FIG. 6, each vinyl member 80 has a front or outer surface 82 which is parallel to a wider, rear surface 84. The surface 84 is bonded to the thin vinyl sheet of the curtain by means of a cold bond glue. Another side 86 of the vinyl member extends perpendicular to the sheet 12 and perpendicular to surfaces 82 and 84. The sloping shoulder 32 is formed on a fourth side 88 of the vinyl member. The sloping side 88 is covered by means of a friction reducing, wear resistant fabric strip 90 which is bonded to the respective side edge section of the curtain. As illustrated in FIGS. 5 and 6, preferably there is a further elongate wear-resistant fabric strip 92 bonded to the side of the curtain 12 opposite the vinyl member 80. The two fabric strips 90 and 92 extend along the side edge section in a direction parallel to the adjacent side edge 22 or 24 of the curtain. The strips 90 and 92 reduce the amount of friction between their respective side edge section and the guide channel 52 or 54.

In a particularly preferred embodiment, each fabric strip 90, 92 is made of one ply polyester monofilament. In order that the fabric strip can be readily attached to the vinyl sheet 12, the fabric strip is coated with polyvinylchloride (PVC) on one side. This one side indicated at 94 is the side bonded to the respective side edge section of the curtain. Preferably, each of the fabric strips 90 has an inner longitudinal section 96 that covers a narrow section of the thin main area of the sheet 12 and is bonded thereto. It will be appreciated that the inner edge 68 of the front plate will tend to rub against the section 96 of the strip and thus the section 96 prevents wear on the sheet 12 arising from long term use of the door. It will be further understood that the second fabric strip 92 serves to reduce the friction between the side edge section of the door and the rear guide member 58.

Figure 4:
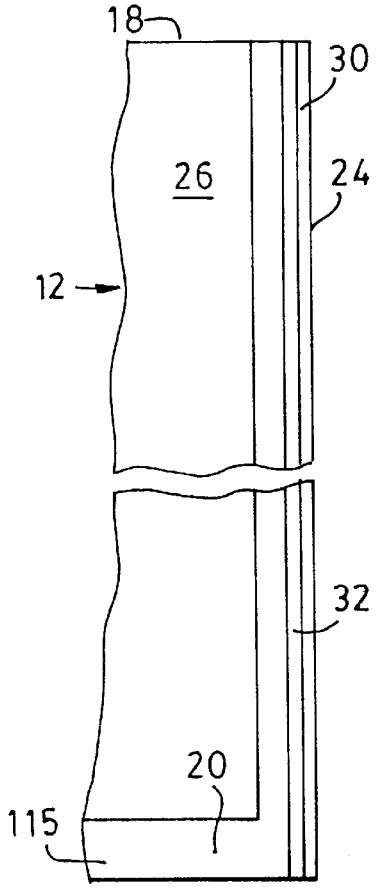
FIG. 4 is a partial cut-away front view of the door curtain used in the door assembly of FIGS. 1 and 2.

In a particularly preferred embodiment, each of the fabric strips 90, 92 can be quite thin and can have a thickness of only about 1.0 mm. Each fabric strip has a glossy outer side 98 for friction reducing purposes. In one preferred embodiment of the door, each of the fabric strips 90, 92 extends substantially from the upper end 18 of the sheet 12 to the lower end 20 as illustrated in FIG. 4. Thus the strip 90 covering the sloping shoulder forms a long, substantially continuous, friction-reducing surface extending lengthwise along the sloping shoulder. However, it is also possible for the fabric strips to be provided as spaced apart vertically extending strip sections with the gap between adjacent ends of the strip sections being as much as four inches. The length of the individual strip sections can be as long as desired, but the sections should not be so short as to result in any undesirable wear on the main sheet 12 of the curtain.

Although the degree of slope of the sloping shoulder can vary, in a particular preferred embodiment of the door, the shoulder 32 slopes outwardly from the transverse centre of the curtain at an angle A of about 45 degrees to the main area of the curtain, this preferred angle being indicated in FIG. 6. Preferably, the angle A of the shoulder is between about 30 to about 45 degrees to the main area of the curtain. It will be appreciated that each side edge section 28, 30 is intended to release under an impact force from its respective guide channel and both the angle A of the sloping shoulder and the fabric strips 90, 92 helps in the release of the side edge section. The angle A must not be so great as to prevent the required release of the side edge section from the channel when the curtain is struck without serious damage to the curtain. Similarly the angle A should not be so small that the side edge section will come out of the channel too easily. There is also a danger if the angle A is quite small that the side edge section could become inadvertently wedged in the throat 70 as a result of ordinary operation of the door or wind or air pressure acting on the door. Also, to assist in the release of the side edge section under an impact force, the front plate 56 is provided with the aforementioned sloping inner edge portion 66, the slope of this portion preferably corresponding to the slope of the shoulder 32. Thus, in a particular preferred embodiment, the slope of the portion 66 is 45 degrees to the flat surface of the curtain 12.

In a known manner, the flexible sheet or curtain 12 is provided with a rigid bottom bar 100 which is attached to the lower end 20 of the curtain and which extends almost the entire width of the curtain, not including the curtain's side edge sections. The illustrated preferred bottom bar comprises two extruded aluminum, elongate bar members 102 and 104 located on opposite sides of the sheet 12. The two bar members are connected together by means of nuts and bolts 106 which are distributed in pairs along the length of the bar members (see FIG. 2). Preferably the weight of the bottom bar 100 can be varied using weights 108 mounted in or on each bar member. As illustrated in FIG. 5, each bar member 102, 104 is formed with several, for example three, elongate cylindrical cavities 110 capable of receiving a number of the weights 108. The weights 108, which may comprise elongate metal rods are inserted into the cavities 110 in order to adjust the total weight of the bottom bar to a desired weight. This desired weight may, for example, depend upon the size of the door and in particular the height thereof. It will be appreciated that a bottom bar of appropriate weight is important to the proper operation of the roll up door since the curtain should have a stretching force acting thereon as it is being raised and lowered. The stretching force helps to maintain the side edge sections in the channels and helps to prevent possible binding of the side edge sections in the channels during operation of the door. If the bottom bar 100 is struck accidently, it will act to pull the thickened curtain edges from the guide channels. Preferably each end of each bar member is provided with a suitable plastic end cap 112 which closes the ends of the cavities 110. Also, as is well known, a safety edge strip 114 should extend along the bottom of the bottom bar 100. The construction of the safety edge strip is well known and need not be described in detail herein. The purpose of the safety edge strip is to prevent the door from closing on a person or object in the doorway, the strip 114 acting to cause the roll-up door to reverse direction and open if the member 114 strikes an object or person.

In one preferred embodiment of the door and as illustrated in FIG. 5, a reinforcing, wear resistant fabric strip 115 extends across the bottom of the sheet 12 on each side of the curtain. The strip 115 is positioned between the bar member 102 or 104 and the sheet 12 and helps to prevent the sheet 12 from being damaged in the event that the bottom bar is struck by strengthening the bottom end portion of the curtain.

In one preferred embodiment of the door, the main area of the curtain 12 has a thickness of 16th inch. A preferred form of this thin sheet for the curtain is sold under the trade-mark DUROTEX. In this preferred embodiment, the PVC member 80 has a width measured along the wide side 84 of 1 inch and a thickness of ½ inch. It will be appreciated that instead of PVC, the member 80 can be made of other suitable flexible materials such as rubber or synthetic rubber.

Figure 1:
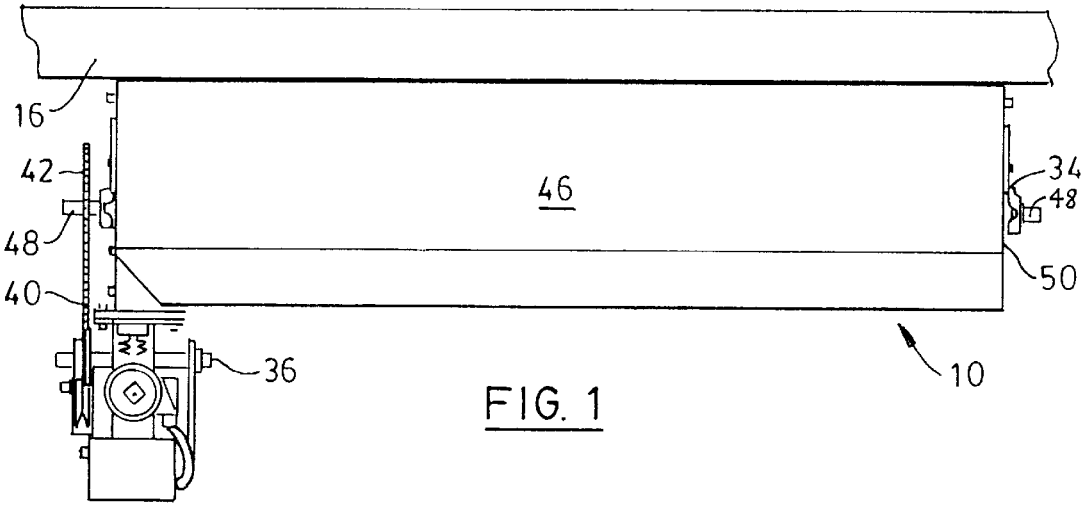
FIG. 1 is a top view of a roll-up door constructed in accordance with the invention, this door being mounted in a doorway formed in a wall.
Figure 2:
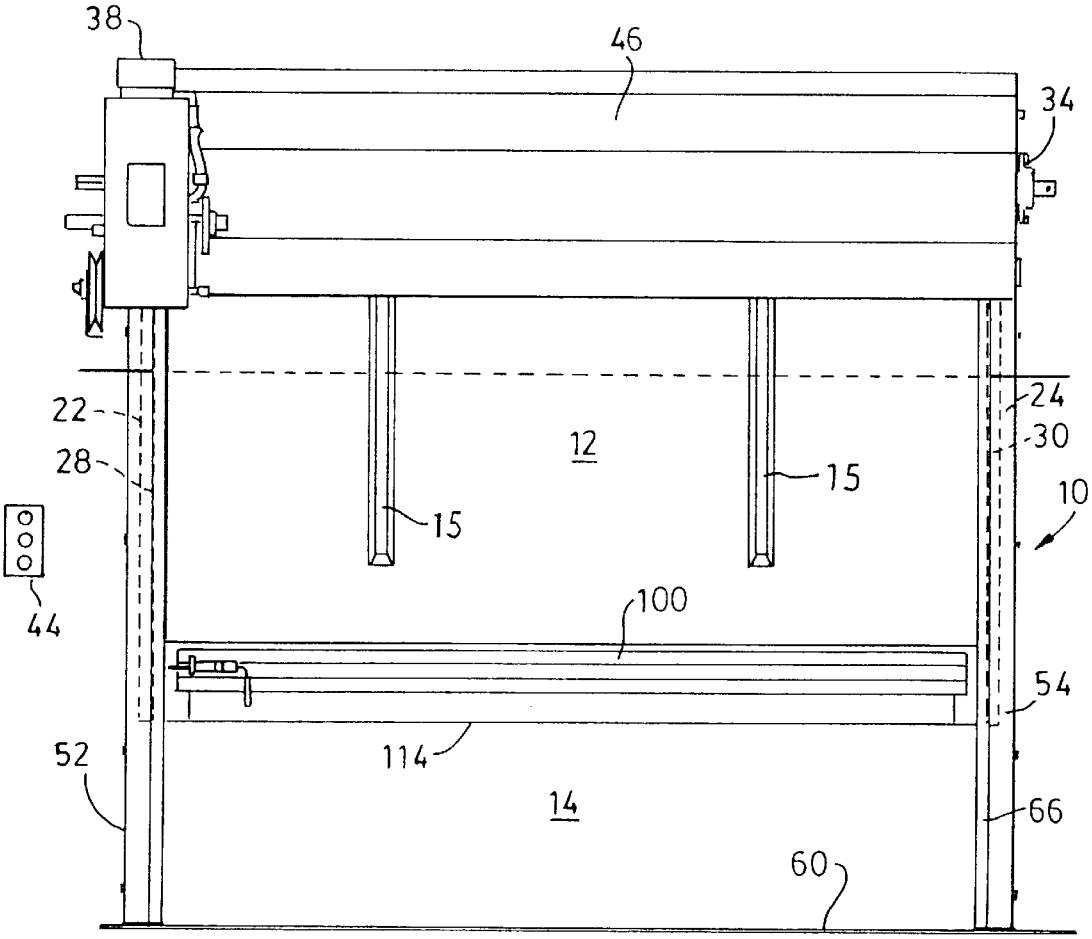
FIG. 2 is a front elevation of the roll-up door of FIG. 1, the door being shown in a partially open position.
Figure 3:
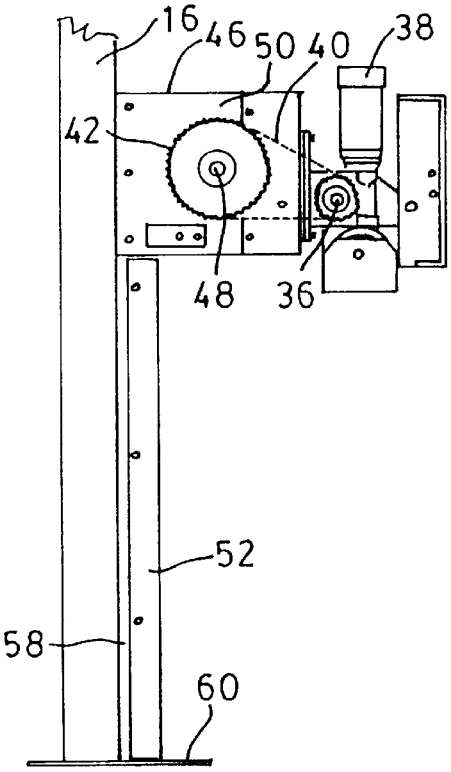
FIG. 3 is a left side view of the roll-up door of FIGS. 1 and 2.

The illustrated roll-up door is provided with two, vertically extending roll strips 15 provided on one side of the curtain as shown in FIG. 2. These strips assist the operation of the door by enabling it to track properly. In other words, these strips tend to keep the curtain rolling evenly. They have the same thickness, i.e. ½ inch, as the members 80 on the door edges and can be made of the same PVC material.

It will be appreciated by those skilled in the construction of roll-up doors that various modifications and changes can be made to the roll-up door of the invention without departing from the spirit and scope of this invention. Accordingly, all such modifications and changes as fall within the scope of the appended claims are intended to be part of this invention.

We claim:

1. A roll-up door comprising:

a flexible sheet forming a curtain for closing a doorway having an upper end, a lower end, and two opposite side edges, said sheet having a relatively thin main area and elongate side edge sections that are thicker than the remainder of said sheet, a sloping shoulder being formed where each side edge section meets said main area;

a curtain winding mechanism having said upper end attached thereto for raising said curtain;

a pair of spaced apart guide channels in which said side edge sections are respectively movable, said side edge sections being engageable respectively with said guide channels; and friction reducing, wear-resistant fabric strips attached to both of said side edge sections and extending therealong in a direction parallel to said side edges, said fabric strips including fabric strips covering and attached to the sloping shoulders and reducing the amount of friction between said side edge sections and their respective guide channels.

2. A roll-up door according to claim 1 wherein said fabric strips are made of one-ply polyester monofilament.

3. A roll-up door according to claim 2 wherein the polyester fabric strips are coated with polyvinylchloride on one side, said one side being bonded to the respective side edge section of the curtain.

4. A roll-up door according to claim 2 wherein each of said fabric strips is bonded to a respective one of said side edge sections, said fabric strips include at least two fabric strips bonded to the sloping shoulders, and each of said at least two fabric strips has an inner longitudinal section that covers a narrow section of said thin, main area of said sheet and is bonded thereto.

5. A roll-up door according to claim 2 wherein each fabric strip has a thickness of about 1.0 mm. and a glossy outer side for engagement with the adjacent guide channel.

6. A roll-up door according to claim 1 wherein each fabric strip is a continuous strip extending substantially from said upper end to said lower end of said sheet.

7. A roll-up door comprising:

a flexible sheet forming a curtain for closing a doorway having an upper end, a lower end, and two opposite side edges, said sheet having a relatively thin main area and elongate side edge sections that are thicker than the remainder of said sheet, a sloping shoulder being formed where each said edge section meets said main area;

a curtain winding mechanism having said upper end attached thereto for raising said curtain;

a pair of spaced apart guide channels in which said side edge sections are respectively movable, said side edge sections being engageable respectively with said guide channels; and friction reducing, wear resistant fabric strips attached to both of said side edge sections, extending therealong in a direction parallel to said side edges, and attached to both sides of each side edge section of the curtain, said fabric strips including fabric strips covering and attached to the sloping shoulders and reducing the amount of friction between said side edge sections and their respective guide channels, wherein the fabric strips covering the sloping shoulders form a long, substantially continuous, friction reducing surface extending lengthwise along each sloping shoulder.

8. A roll-up door according to claim 7 wherein said flexible sheet is made of vinyl.

9. A roll-up door according to claim 7 wherein a rigid bottom bar is attached to said lower end of the curtain, said bottom bar is formed with a number of elongate cavities for receiving a number of weights, and weights are mounted in said cavities in order to adjust the total weight of the bottom bar to a desired weight.

10. A roll-up door according to claim 7 wherein each guide channel includes an elongate, metal front plate and an elongate, metal rear guide member and said front plate has a sloping inner edge portion extending to an inner edge which extends vertically when the door is installed, a narrow throat being formed between said inner edge and one side of the rear guide member, said curtain extends through the throat formed by each guide channel, and each side edge section of the sheet has a total thickness which is greater than the width of said throat so that the thicker side edge section is normally trapped in its respective guide channel.

11. A roll-up door comprising:

a vertically movable flexible curtain for closing a doorway, said curtain having an upper end, a lower end, and side edges, said curtain having a relatively thin main area and a thicker strip along a substantial length of each side edge with each strip forming a windlock, a sloping shoulder being formed where each strip meets said main area;

a curtain winding mechanism having said upper end attached thereto for raising and lowering said curtain;

a curtain guide system including a pair of spaced apart guide channels in which said side edges including the thicker strips are respectively movable, each thicker strip being engageable with its respective guide channel; and friction reducing, wear resistant polyester fabric strips bonded to both of the thicker strips and extending therealong in a direction parallel to said side edges, said fabric strips including fabric strips covering and bonded to the sloping shoulders and reducing the amount of friction between said thicker strips and their respective guide channels when the curtain is raised or lowered.

12. A roll-up door according to claim 11 wherein each thicker strip is formed by an elongate vinyl member of substantially uniform transverse cross-section bonded to a respective side edge section of a vinyl sheet forming most of said curtain.

13. A roll-up door according to claim 12 wherein each guide channel comprises an elongate, metal rear guide member and an elongate, metal front plate, said metal front plate having a sloping inner edge portion extending to an inner edge which extends vertically when the door is installed, a narrow throat being formed between said inner edge and one side of the rear guide member.

14. A roll-up door according to claim 13 wherein said front plate is connected to said rear guide member, said curtain extends through the throat formed by each guide channel, and each thicker strip of the curtain has a total thickness which is greater than the width of said throat so that the thicker strip is normally trapped in its respective guide channel.

15. A roll-up door according to claim 13 wherein at least one of said fabric strips covers each sloping shoulder, which is formed by the elongate vinyl member, and other of said fabric strips are bonded to a side of said curtain which is opposite the side to which the elongate vinyl members are bonded.

16. A roll-up door according to claim 12 wherein each fabric strip has a maximum thickness of about 1.0 mm. and a glossy outer side for engagement with the adjacent guide channel.

17. A roll-up door according to claim 12 wherein each sloping shoulder slopes outwardly away from the transverse centre of the curtain at an angle ranging between about 30 to about 45 degrees to said main area of the curtain.

18. A roll-up door according to claim 11 wherein said fabric strips are bonded to both sides of said curtain at said side edges.

19. A roll-up door according to claim 18 wherein said fabric strips covering the sloping shoulders form a long, substantially continuous, friction-reducing surface extending lengthwise along each sloping shoulder.

20. A roll-up door according to claim 19 wherein said fabric strips are made of one-ply monofilament fabric that is coated with polyvinylchloride on one side, said one side being the side bonded to the side edge of the curtain.

21. A roll-up door according to claim 18 wherein said fabric strips covering the shoulders each extend substantially continuously from said upper end of said curtain to said lower end thereof.

22. A roll-up door according to claim 11 wherein said fabric strips are made of one-ply monofilament fabric that is coated with polyvinylchloride on one side, said one side being the side bonded to the side edge of the curtain.

23. A roll-up door according to claim 11 wherein each sloping shoulder slopes outwardly away from the transverse centre of the curtain at an angle of about 45 degrees to said main area of the curtain.

* * * * *